United States Patent [19]

Sfikas

[11] Patent Number: 4,645,241

[45] Date of Patent: Feb. 24, 1987

[54] LAMINATING ENVELOPE

[76] Inventor: Nicholas Sfikas, 29 Widewaters La., Pittsford, N.Y. 14534

[21] Appl. No.: 807,177

[22] Filed: Dec. 10, 1985

[51] Int. Cl.[4] ..... B42F 7/00; B42D 15/00; B65D 27/00

[52] U.S. Cl. ..... 283/109; 283/106; 229/70

[58] Field of Search ..... 283/106, 107, 109, 98; 282/25; 229/70, 68 R

[56] References Cited

U.S. PATENT DOCUMENTS

| | | | |
|---|---|---|---|
| 3,512,780 | 5/1970 | Allison | 283/106 |
| 3,701,468 | 10/1972 | Steinhauser | 229/70 |
| 3,762,628 | 10/1973 | Sargent | 229/70 |
| 4,097,067 | 6/1978 | Schechter | 283/106 |
| 4,128,954 | 12/1978 | White | 283/106 |
| 4,232,079 | 11/1980 | Raphael et al. | 283/109 |
| 4,509,196 | 4/1985 | Sak et al. | 283/109 |

*Primary Examiner*—Paul A. Bell
*Assistant Examiner*—Paul M. Heyrana
*Attorney, Agent, or Firm*—Shlesinger, Arkwright, Garvey & Fado

[57] ABSTRACT

A laminating envelope has first, second and third rectangular panels which are sequentially secured together along longitudinal edges. Each of the panels has a front and a rear surface and at least one of the panels is transparent. The first and second panels are disposed in facial relation and the aligned edges thereof are secured together for providing a pocket between the panels. A score line in the third panel extends between the third panel side edges. The second panel side edges have a length exceeding the first panel edge length by at least the width of the score line and the third panel side edges are substantially equal in length to the second panel side edges. Adhesive is disposed over the first panel rear surface so that folding of the third panel along the score line causes the third panel rear surface to be in facial relation therewith and secured to the first panel rear surface by the adhesive for thereby securing and sealing the pocket.

10 Claims, 4 Drawing Figures

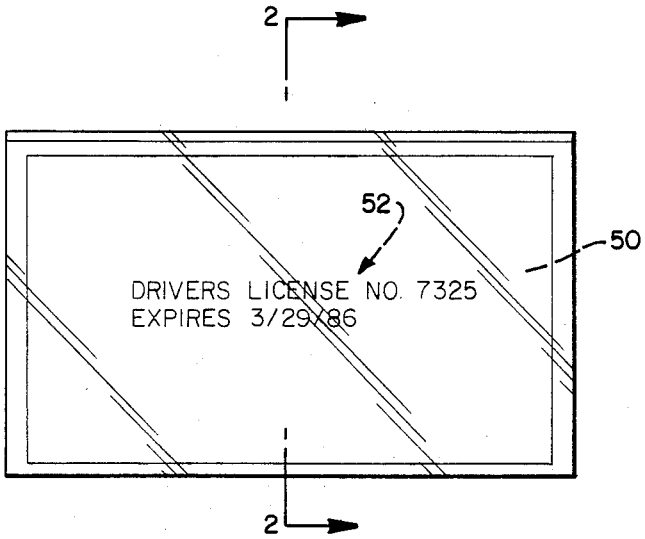
FIG 1
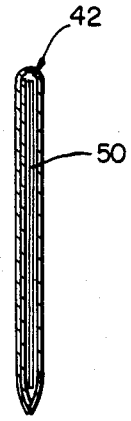
FIG 2
FIG 3
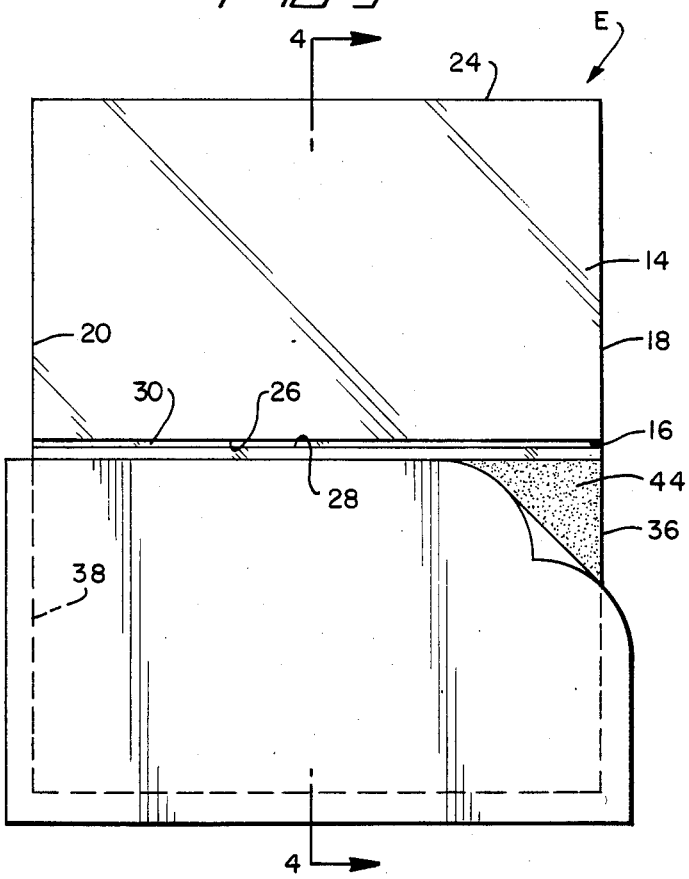
FIG 4
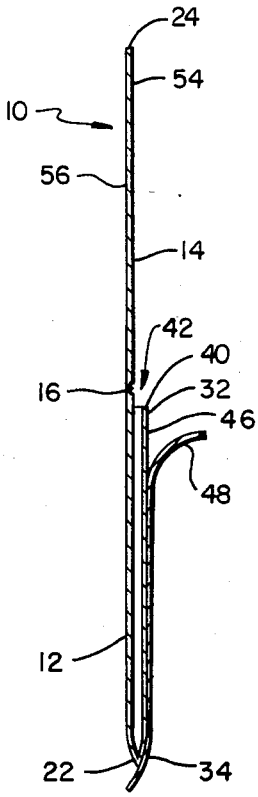

LAMINATING ENVELOPE

BACKGROUND OF THE INVENTION

Lamination is a well known process for preserving indicia-bearing materials, particularly printed cards, such as business cards, social security cards, drivers licenses and the like. In a typical lamination process, the card to be preserved is sandwiched between two relatively large transparent plastic layers which are secured together around the periphery of the card. In this way, the outer plastic laminate layers protect the card.

Typically, the outer laminate layers are permanently secured together, usually by heat sealing. Heat sealing prevents the card from being removed from between the laminate layers and thereby maintains the integrity of the card and the indicia imprinted on the card. Should the indicia require alteration, however, then a new laminated card must be provided if conventional laminating processes are used. Attempts to alter the indicion the laminated card will therefore result in the destruction of the card. It can be appreciated, therefore, that this permanent lamination can result in increased costs when the particular card may require frequent alteration.

It is also known to laminate the card between two adhesively secured plastic layers. Typically, the adhesive covers substantially the entire surface of both laminate layers. Therefore, the card is also adhesively secured to the laminate layers. This is undesireable because, again, the card may become damaged if the layers are separated and will almost certainly have adhesive on its surfaces. Therefore, it will again generally require the preparation of an entirely new card when alterations of some of the indicia is required.

From the above, it can be seen that a new means for laminating a card or the like which permits non-destructive access to the card in the event alteration is necessary is desireable. The disclosed invention provides a laminating envelope that solves this need and is inexpensive and easy to use.

OBJECTS AND SUMMARY OF THE INVENTION

The primary object of the disclosed invention is to provide a laminating envelope which preserves the integrity of an indicia-bearing card and yet which permits non-destructive access to the card in the event alteration of the indicia is necessary.

A further object of the disclosed invention is to provide a laminating enevelope having means to assure proper alignment of the laminate layers.

Still another object of the disclosed invention is to provide a laminating envelope which permits the indicia-bearing card to be selectively removed without being damaged.

Yet another object of the disclosed invention is to provide a laminating envelope which permits the card to be laminated without requiring heat sealing or other laminating equipment.

Another object is to provide a laminating envelope having means indicating that the card or envelope have been tampered with.

In summary, the disclosed laminating envelope has first, second and third rectangular panels which are sequentially connected along the longitudinal edges thereof. The first and second panels are secured together along three edges thereof in order to provide a pocket between the panels. A score line in the third panel extends between the side edges and is adjacent the interconneted longitudinal edges of the second and third panels. The second panel has a length which exceeds the length of the first panel by at least the width of the score line and the third panel length is substantially equal to the second panel length. An adhesive is disposed over the rear surface of the first panel so that, after insertion of a card into the pocket, folding of the third panel along the score line causes the third panel to be adhesively secured to the first panel and the remote longitudinal edge of the third panel to be aligned with the secured longitudinal edges of the first and second panels. In this way, the score line assures proper alignment of the panels and thereby avoids the need for sophisticated laminating equipment.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a front plan view of the laminating envelope of the invention;

FIG. 2 is a cross-sectional view thereof taken along the section 2—2 of FIG. 1;

FIG. 3 is a rear plan view of the envelope; and,

FIG. 4 is a cross-sectional view taken along the section 4—4 of FIG. 3.

DESCRIPTION OF THE INVENTION

Laminating envelope E, as best shown in FIGS. 3 and 4, includes a transparent thermoplastic rectangular sheet 10 which is divided into panels 12 and 14 by score line 16. Score line 16 extends between and is transverse to side edges 18 and 20 of sheet 10. Sheet 10 also has longitudinal edges 22 and 24 which extend parallel to score line 16 and transverse to side edges 18 and 20.

Score line 16 has spaced parallel edges 26 and 28 between which base section 30 extends. The distance from edge 26 to longitudinal edge 24 is substantially equal to the distance between edge 28 and longitudinal edge 22, for reasons to be explained. The base section 30 has a width slightly in excess of the thickness of a business card, for reasons to be explained. Score line 16 is equidistant longitudinal edges 22 and 24 so that panels 12 and 14 will have equal side edge lengths.

Transparent thermoplastic panel 32, as best shown in FIG. 4, has a width defined by its longitudinal edge 34 substantially equal to the width of longitudinal edge 22, Panel 32 has side edges 36 and 38 which are secured by heat sealing to the associated aligned edges 18 and 20, respectively, of sheet 10. Likewise, longitudinal edge 34 is secured by heat sealing to longitudinal edge 22. It can be seen therefore, that the longitudinal edges of the panels 12, 14 and 32 are sequentially connected together. That is, a longitudinal edge of panel 14 is connected to the adjacent aligned longitudinal edge of panel 12. The opposite longitudinal edge 22 of panel 12 is likewise connected to aligned longitudinal edge 34 of panel 32. Longitudinal edge 40 of panel 32 is not, however, secured to sheet 10 and, in this way, provides a pocket 42 which is disposed between panels 12 and 32. It can be noted in FIGS. 3 and 4 that the side edges 36 and 38 of panel 32 have a length which is less than the corresponding side edge length of panel 12. The side edges 36 and 38 of panel 32 have a length which is less than the associated side edge length of panel 12 by an amount substantially equal to the width of section 30. Because edge 40 is spaced from edge 28, access to pocket 42 is easy.

Contact adhesive 44 is disposed substantially over the entire rear surface 46 of panel 32. It should be obvious that each of the panels 10, 12 and 32 has a front surface and a rear surface. Release strip 48 is releaseably secured to panel 32 by adhesive 44 and may be slectively removed therefrom to expose adhesive 44.

As best shown in FIGS. 1 and 2, card 50 is positioned within pocket 42 of envelope E. Card 50 is, typically, rectangular in shape and usually bears printed indicia, such as indicia 52. Frequently, portions of indicia 52:may require alteration and it is toward permitting that alteration that the envelope E is conceived.

As best shown in FIG. 2, release strip 48 has been removed from rear surface 46. Card 50 has been inserted into pocket 42. Third panel 14 has then been folded along score line 16 which causes longitudinal edge 24 to be aligned with longitudinal edge 34 where it is joined to edge 22. Rear surface 54 of panel 10 is therefore adhesively secured to rear face 46 of panel 32. In this way, card 50 is laminated in the envelope E and the pocket 42 is sealed.

In the event that indicia 52 requires alteration, then envelope E may be opened by being slit along score line 16. The card 50 may then be removed from the pocket 42 without damage because it is not secured to either panel 12 or panel 32. Naturally, a new envelope E will be required if the card 50 is to be laminated in its altered form. Should someone attempt ro access card 50 by peeling panel 14 away from panel 32, then such efforts will be immediately noticeable because the contact adhesive 44 will be mottled and otherwise acquire a dissimilar surface appearance. The attempt will therefore be readily recognizable, particularly because it is necessary to essentially remove the entire panel 14 from its overlying facial relation with panel 32.

The score line 16 assures that the longitudinal and side edges of the panel 14 are properly overlayed in facial relation with the corresponding edges of panel 32. As above pointed out, separation of the panel 14 from the contact adhesive 44 is readily noticeable and therefore requires proper alignment of the panels prior to sealing of the pocket 42. The score line 16, because of its spaced edges 26 and 28, respectively, therefore provides an alignment means for the edges of the panel 14 which alignment means becomes operative when panel 14 is folded along the score line 16. Furthermore, the width of the base section 30 is such that the edges 24 and 34 are aligned, even when a card of greater than normal thickness is inserted into the pocket 42.

Because the panels 12 and 14 have substantially equal length, as defined by the side edges 18 and 20, the envelope E does not have the longitudinal edge 24 extending intermediate edges 40 and 34. This therefore prevents distortion of indicia 52 as may occur when the longitudinal edge 24 is not properly sized and positioned. This distortion can be important when accuracy of the indicia is important, such as with coded indicia.

OPERATION AND USE

Use of the laminating envelope E of the invention is easy and straightforward and requires no equipment to effecuate the sealing of pocket 42. The envelope E may be appropriately sized to accept almost any size card 50. It is merely required that the dimensions of pocket 42 exceed the dimensions of the card 50 so that the card 50 may be easily inserted or removed therefrom.

After the appropriate envelope E has been selected, then the card 50 is inserted into the pocket 42 so that the card comes to rest against the interconnected longitudinal edges 22 and 34 of the panels 12 and 32. The panel 14 is then folded along score line 16 so that the sheet 10 has a V-like configuration. Release strip 48 is then removed from adhesive 44 in order to expose the adhesive 44. Panel 14 is then folded again along scoreline 16 which causes the longitudinal edge 24 to be aligned with longitudinal edge 34 and the side edges 20 and 18 to be aligned with the corresponding side edges 36 and 38, respectively, of the panel 32. Pressing on front surface 56 of sheet 10 thereby causes the panel 14 to be adhesively secured to the panel 32 so that the pocket 42 is sealed. The card 50 is then laminated in the pocket 42 of the envelope E.

In the event alteration of indicia 52 is necessary, then the score line 16 is slit so as to open the pocket 42 to access card 50. The card 50 may then be removed and the appropriate alterations made. It can be noted that the card 50 has not been damaged by the lamination process because the card 50 does not come into contact with adhesives or other securement means of the panels. Rather, the card 50 is loosely received between the panels 12 and 32.

While this invention has been described as having a preferred design, it is understood that it is capable of further modifications, uses and/or adaptions of the invention following in general the principle of the invention and including such departures from the present disclosure as come within known or customary practice in the art to which the invention pertains, and as may be applied to the essential features hereinbefore set forth, and fall within the scope of the invention of the limits of the appended claims.

What I claim is:

1. A card holder, comprising:

(a) a first rectangular transparent thermoplastic panel with first and second longitudinal edges and first and second side edges transverse to said longitudinal edges;

(b) a first rectangular transparent thermoplastic sheet with first and second longitudinal edges and first and second side edges transverse to said longitudinal edges;

(c) a score line in said sheet equidistant said sheet longitudinal edges extending between and transverse to said sheet side edges and providing second and third panels and said scoreline having a predetermined width;

(d) each of said panels having a front and a rear surface;

(e) and wherein the length of the side edges of said second and third panels exceeds the length of the side edges of said first panel side edges by at least the width of said scoreline;

(f) said first panel front surface disposed in facial relation with said second panel rear surface so that said first and second panels side edges and said first longitudinal edges are aligned;

(g) said aligned edges heat sealed together for providing a pocket between said first and second panels; and, (h) adhesive means disposed over said first panel rear surface so that folding of said third panel along said score line causes said third panel rear surface to be secured to said first panel rear surface by said adhesive means and said first, second and third panel side edtes to be aligned and said third panel free longitudinal edge to be aligned with said secured longitudinal edges.

2. The holder of claim 1, wherein:

(a) a removable release strip covers said adhesive means.

3. The card holder of Claim 1, wherein:

(a) said adhesive mean includes a contact adhesive so that separation of said third panel from said first panel is readily indicated.

4. The card holder of Claim 1, wherein:

(a) a card is positioned in said pocket.

5. The card holder of Claim 1, wherein:

(a) said longitudinal edges of said panels have equal length and the length of said longitudinal edges exceeds the length of said side edges.

6. The card holder of claim 1 in combination with an indicia bearing member wherein said member is positioned in said pocket and said third panel is foled along said score line and secured to said first panel by said adhesive means.

7. A laminating envelope, comprising:

(a) a generally rectangular transparent sheet having a pair of longitudinal edges and a pair of side edges and a front and a rear surface;

(b) a scoreline in said sheet equidistant said longitudinal edges and transverse to said side edges defining first and second generally rectangular panels of uniform dimensions;

(c) a third transparent generally rectangular panel with a pair of longitudinal edges and a pair of side edges and a front and a rear surface and with a width substantially equal to the width of said second panel and a length less than the length of said second panel;

(d) said third pnael overlying and in facial relation with said second panel and one longitudinal edge of said third panel heat sealed to the remote longitudinal edge of said second panel and said side edges of said second and third panels heat sealed together along the length thereof so that the free longitudinal edge of said third panel is spaced from said scoreline and a pocket is provided between said second and third panels;

(e) adhesive means covering said third panel front surface; and, (f) a release strip removably covering said adhesive means so that said first panel may be folded along said scoreline so that the free longitudinal edge thereof is coextensive with said sealed together longitudinal edges of said second and third panels and so that said adhesive means may secure said first panel rear surface to said third panel front surface and thereby seal said pocket.

8. The envelope as defined in claim 7, wherein:

(a) said adhesive means is disposed over substantially the entirety of said first panel rear surface.

9. The evelope as defined in claim 7, wherein:

(a) said scoreline has first and second spaced apart parallel edge sections, each of said sections defining a longitudinal edge of said first and second panels.

10. The envelope as defined in claim 7, wherein:

(a) said adhesive means comprise a pressure sensitive adhesive so that separation of said secured first and third panels will be apparent.

* * * * *